US005592786A

United States Patent [19]

Kamm

[11] Patent Number: 5,592,786

[45] Date of Patent: Jan. 14, 1997

[54] WALL PROTECTOR

[75] Inventor: Christian P. Kamm, Fairview Park, Ohio

[73] Assignee: Wilkinson Company, Stow, Ohio

[21] Appl. No.: 456,696

[22] Filed: Jun. 1, 1995

[51] Int. Cl.[6] ..... E04F 11/18

[52] U.S. Cl. ..... 52/28; 52/33; 52/718.04; 52/220.7; 256/1; 362/147

[58] Field of Search ..... 52/718.02, 717.03, 52/717.05, 174, 28, 33, 718.01, 718.04, 717.06, 184, 288.1, 290, 220.1; 256/1; 248/251, 345.1, 48.2, 223.41, 225.11; 174/48, 68.3, 101; 362/147, 227, 249, 391, 432, 156

[56] References Cited

U.S. PATENT DOCUMENTS

| | | | |
|---|---|---|---|
| 2,192,309 | 3/1940 | Hall | 52/718.05 X |
| 3,511,942 | 5/1970 | Quigley | 52/28 X |
| 3,777,438 | 12/1973 | Brown | 52/173 |
| 3,842,564 | 10/1974 | Brown | 52/716 |
| 4,078,773 | 3/1978 | Ellingson, Jr. | 356/65 |
| 4,196,552 | 4/1980 | Bartlett | 256/1 X |
| 4,200,261 | 4/1980 | Bartlett | 256/59 |
| 4,376,966 | 3/1983 | Tieszen | 362/249 |
| 4,726,152 | 2/1988 | Vagedes et al. | 52/28 |
| 4,920,708 | 5/1990 | MacLeod et al. | 52/28 X |
| 5,288,048 | 2/1994 | Shreiner | 248/251 |
| 5,397,093 | 5/1995 | Chubb et al. | 52/28 X |

*Primary Examiner*—Carl D. Friedman
*Assistant Examiner*—Timothy B. Kang
*Attorney, Agent, or Firm*—Vickers, Daniels & Young

[57] ABSTRACT

A wall protector is shown which comprises a metallic bumper portion having a generally hollow interior. The bumper is clamped to a holding bracket which is in turn fastened to a wall-mounted bracket. A light source is mounted on the bumper to provide illumination. The holding bracket can be mounted and repositioned along the length of the bumper and the fastener attaching the holding bracket to the mounting bracket is accessible from beneath the latter.

33 Claims, 3 Drawing Sheets

WALL PROTECTOR

The present invention is directed toward a wall protector, and more specifically, to an illuminated wall protector which can be mounted in close proximity to a wall.

BACKGROUND OF THE INVENTION

Modern walls such as the ones used in businesses and other commercial settings are often made of a gypsum wallboard or plasterboard. This material is easy to work with and install and is long lasting under normal conditions. However, it is also relatively easy to damage, and a dent or hole can easily be made in such walls if an object impacts thereagainst. Repairing such damage is time consuming, and if the paint or wall covering in the vicinity of the hole is damaged, repairs can become quite expensive. Other wall types are more resistant to structural damage, but the finish or covering thereon may still be easily damaged and require costly repairs.

Such damage can occur anywhere that large objects are being moved by hand or by a wheeled cart or hand truck. Wall damage is a particular problem in high traffic areas such as hospitals and hotels where stretchers and service carts are in constant use. Hospital stretchers are frequently parked against walls, and in emergencies, there is little time to worry about wall damage. Likewise in hotels, the daily use of cleaning carts, wheeled room service tables and laundry carts will eventually lead to wall damage. Wheeled garbage carts can cause similar problems in a wide variety of settings.

In industrial settings such as factories and warehouses, the appearance of walls is not of great concern, and concrete or cinder blocks may be used to provide practically indestructible walls. However in hospitals and hotels, for example, it is important to preserve the appearance of hallways and rooms, despite the high potential for wall damage. Various types of wall protectors have been employed in the past with various degrees of success. Wooden handrails, if properly positioned, can afford some degree of protection to the walls on which they are mounted. However, the finished surfaces of these rails can be scratched and dented by carts and stretchers. This does not solve the original problem but merely shifts it to a new surface. Protective padding can also be hung on walls, but for aesthetic as well as practical reasons, this is usually only done temporarily, such as when large furniture is being moved.

U.S. Pat. Nos. 3,842,564 to Brown, 4,078,773 to Ellington and 5,288,048 to Shriener all disclose handrails which could be used to protect walls in high traffic areas. However, all show relatively complex structural designs which would lead to high manufacturing costs. Furthermore, the devices of Brown and Ellington must be positioned far enough from a wall to allow access to fastening screws and bolts located between the rail and the wall. The relatively long bracket needed to create this spacing provides a torque arm long enough to allow the mounting brackets to be pulled from the wall if significant downward force is exerted on the rail. Additionally, the openings on the rail portions of these prior art protectors must be carefully aligned with the openings on the mounting brackets. This requires carefully measurement during installation. If any openings are out of alignment, new holes will be needed in the wall or rail. There is no relative adjustability between the rail and the mounting hardware. The complex designs and limited effectiveness of these and other known handrails make such devices less than satisfactory for protecting an underlying wall.

SUMMARY OF THE INVENTION

These and other problems are overcome by the present invention which comprises a protective bumper mounted in close proximity to a wall and which can be attached to and removed from wall brackets from beneath to avoid the necessity of accessing fasteners located between the wall and bumper. In accordance with a preferred embodiment of the invention, the mounting brackets can be positioned independently of the bumper and attached to any portion of the bumper with equal ease, without drilling holes in the bumper itself. It is therefore not necessary that the brackets be precisely located with respect to the bumper. In accordance with another aspect of the invention, the bumper is provided with lights to provide additional illumination in general, or for connection to a building's emergency lighting system to guide persons toward exits in the event of an emergency. In accordance with a further aspect of the present invention, the bumper has an interior cavity which allows the bumper to deform slightly upon impact to increase the shock absorbing ability of the bumper and to reduce the amount of force transmitted to the underlying wall in the event of an impact. The bumper is also preferentially comprised of interchangeable segments which can be cut to length and which can be easily replaced if one section is severely damaged.

The subject wall protector is thus structurally simple, which minimizes the manufacturing expense. This simple structural design also increases the ease of installation and reduces installation costs. Furthermore, by allowing for nearly flush mounting against a wall, the subject invention optimizes the use of available space in a hallway or room where the protector is mounted and improves the structural integrity of the protector.

It is therefore a principal object of the present invention to provide a wall-mounted protective bumper which can be mounted in close proximity to a wall.

It is another object of the present invention to provide a bumper for preventing wall damage which also functions as a source of emergency light.

It is a further object of the present invention to provide a wall-mounted bumper which can be attached to supporting wall brackets using fasteners which are easily accessible when the bumper is flush with or minimally spaced from a wall.

It is another object of the present invention to provide a wall-mounted bumper with improved shock absorbing characteristics.

It is yet another object of the present invention to provide a wall-mounted bumper having support brackets which can be attached at any location along the bumper.

It is yet a further object of the present invention to provide a wall-mounted bumper having lighting and a hollow interior for containing a lighting power supply.

It is still another object of the present invention to provide a wall-mounted bumper which is structurally simple and compact.

It is still a further object of the present invention to provide a wall-mounted protective bumper which can also function as a handrail.

It is another object of the present invention to provide a protective bumper and mounting bracket arrangement which is more economical to manufacture and install than arrangements heretofore available.

BRIEF DESCRIPTION OF THE DRAWINGS

These and other objects of the present invention will become clear from a reading and understanding of the following detailed description of a preferred embodiment of the invention in connection with the accompanying drawings in which.

DETAILED DESCRIPTION OF THE PREFERRED EMBODIMENT

Figure 1:
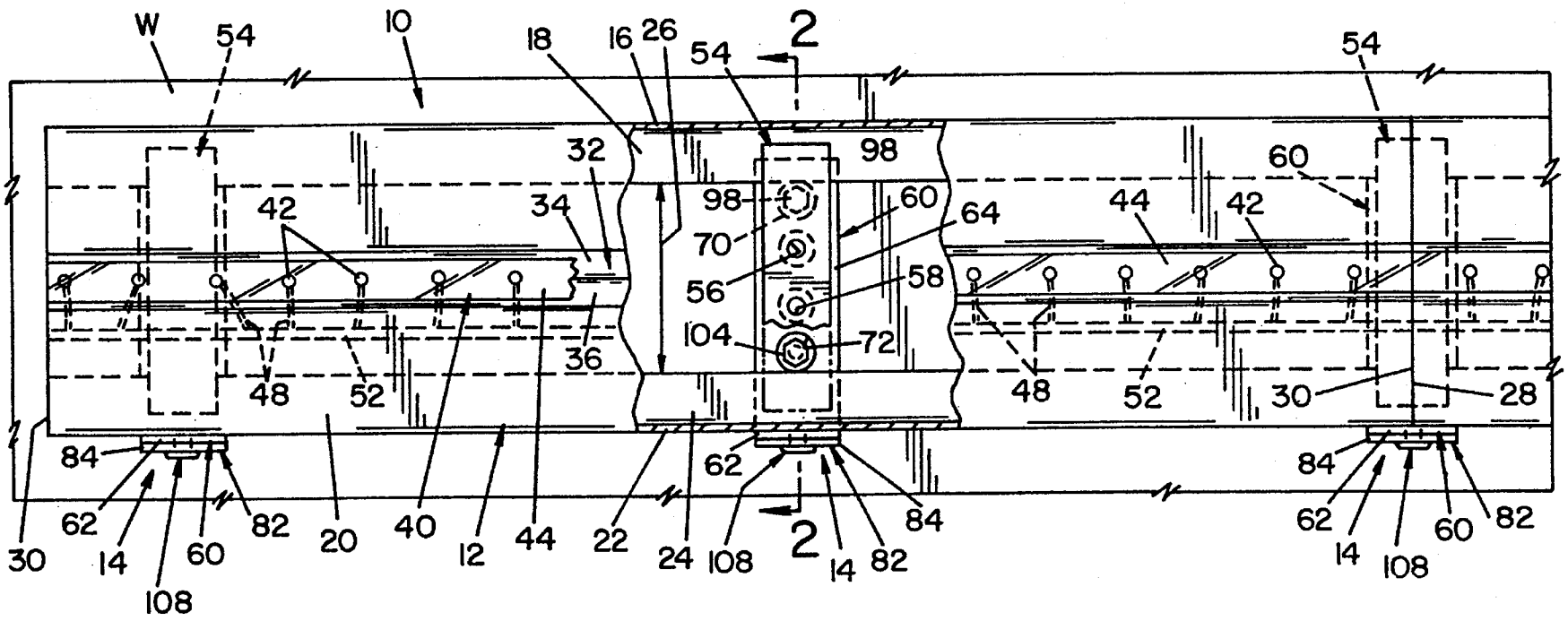
FIG. 1 is a front elevation view, partly in section, of a wall protector according to the present invention.
Figure 2:
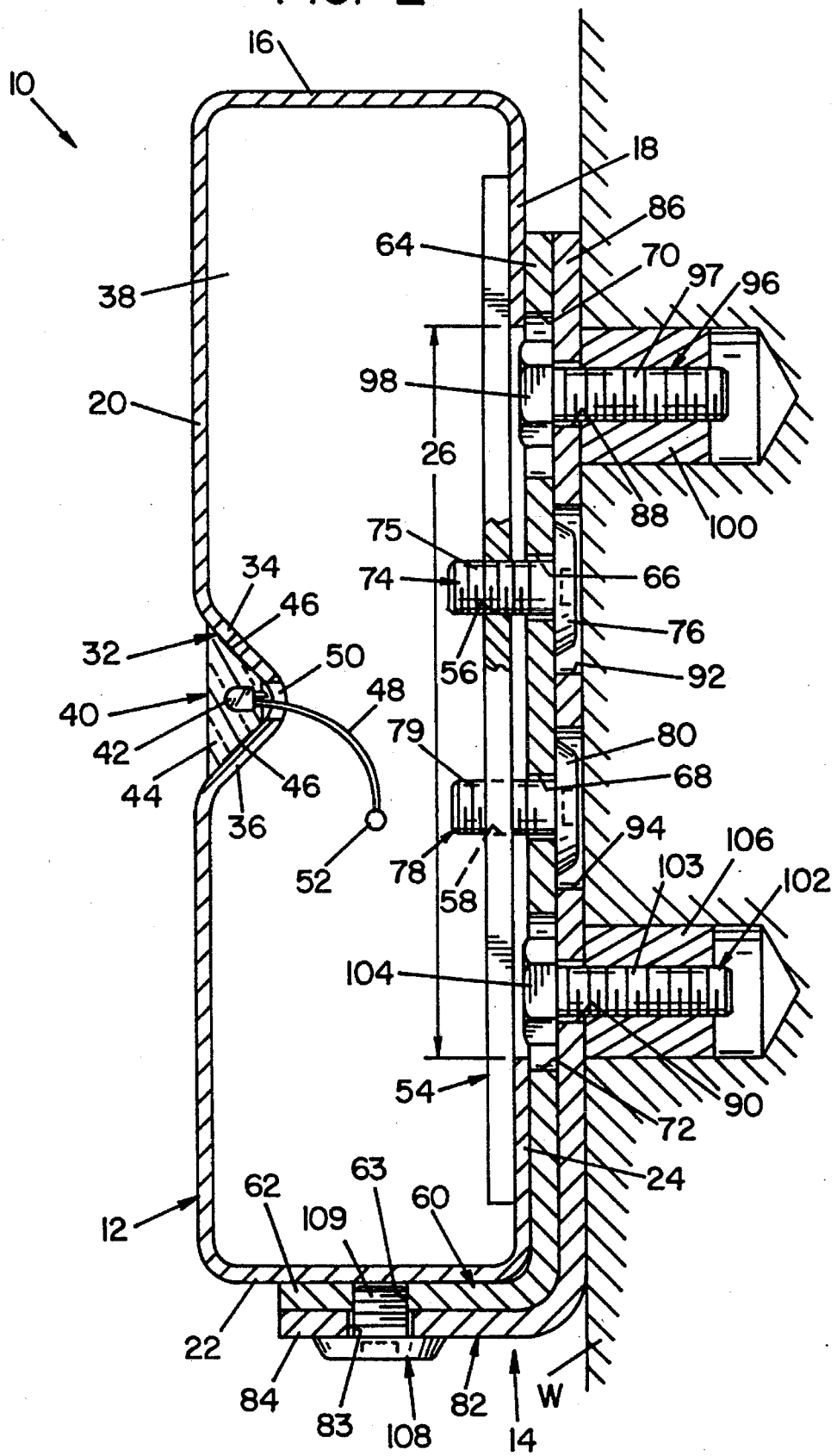
FIG. 2 is a cross-sectional elevation view of the wall protector taken along line 2—2 in FIG. 1.
Figure 3:
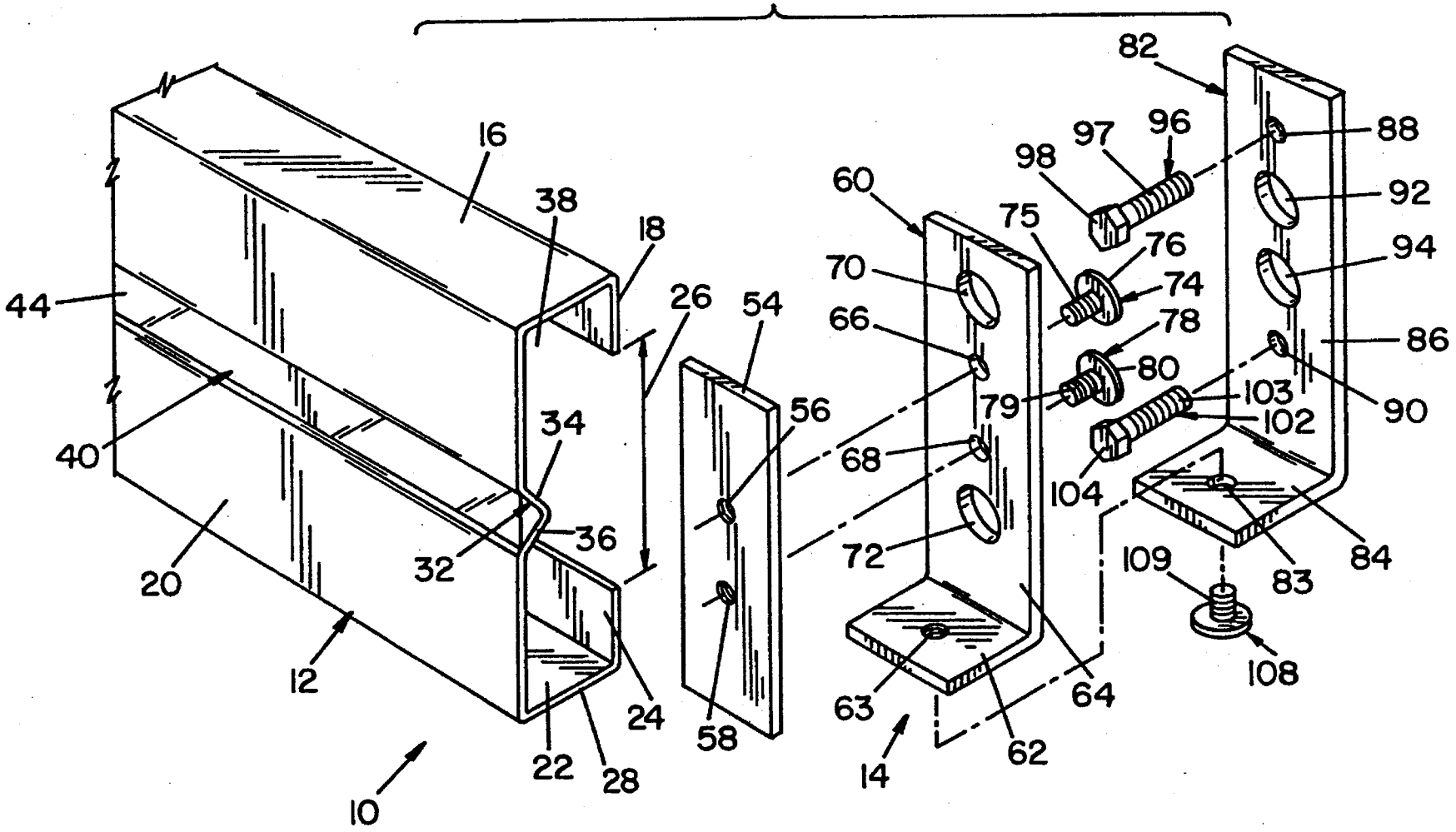
FIG. 3 is an exploded perspective view of the subject wall protector.

Referring now to the drawings, where the showings are for the purpose of illustrating a preferred embodiment of the invention only and not for limiting same, a wall protector 10 according to the present invention comprises a bumper or rail 12 and mounting bracket assemblies designated generally by the numeral 14. Bumper 12 includes a top wall 16 with a rear flange 18 depending perpendicularly therefrom, a front wall 20 perpendicular to top wall 16 and a bottom wall 22 parallel to top wall 16 and having an upwardly extending rear flange 24 co-planar with flange 18 and spaced apart from flange 18 by a gap 26. Bumper 12 extends longitudinally between a first end 28 and a second end 30 and may be of any length. Front wall 20 further includes a V-shaped channel 32 having an upper wall 34 and a lower wall 36, which walls meet at approximately a right angle. Channel 32 is centered in front wall 20 approximately equidistant from top wall 16 and bottom wall 22 and runs parallel to the top and bottom walls between first end 28 and second end 30. Bumper 20 has a generally rectangular cross-section and provides an interior space 38. This interior space allows the walls of the bumper to flex and absorb an impact without permanently deforming the bumper. In the preferred embodiment, the length of bumper 12 ranges from 5 inches to 10 feet. As will become apparent hereinafter, any desired length may be obtained by using multiple wall protectors 10 attached end to end along a section of wall to be protected.

A light strip 40 comprising a number of light bulbs 42 enclosed by a housing 44 is coextensive with and mounted in channel 32 by a suitable adhesive 46. Light strip 40 may be of any design which will fit within channel 32 and a light strip manufactured by Celestial Lighting, Inc. and sold under the commercial name "Dynolite Series CT 2005" has been found to provide satisfactory results. The latter is a 12 volt light strip sealed in a triangular, tubular housing of polycarbonate plastic. Preferably, adhesive 46 is a formica cement manufactured by 3M and sold under the name HIGHBOND 80. A power cord 48 extends away from light strip 40 and passes through an opening 50 in the bottom of channel 32 at the junction of walls 34 and 36 and into interior space 38 where it is connected to power line 52. Power to the light strip is preferably controlled as part of an emergency power system so that lights 42 will be activated in emergency situations when other lighting has failed. Alternatively, or in conjunction with the latter, the lights may be controlled by a switch, not shown, in a conventional manner. In either event, light emitted from the wall protector will both illuminate and clearly define the boundaries of the hallway or room in which it is used. Methods of controlling emergency lighting are well known and do not comprise a part of the subject invention.

Mounting bracket assembly 14 comprises a retaining strip 54 which is located in the interior 38 of bumper 12 and which spans gap 26 and rests against flange 18 and flange 24 and includes a first threaded opening 56 and a second threaded opening 58. Bracket assembly 14 further includes an L-shaped holding bracket 60 having a short leg 62 partially underlying bottom wall 22 and a long leg 64 overlying flange 24, gap 26 and part of flange 18. Holding bracket leg 64 includes a first opening 66 aligned with opening 56 and a second opening 68 aligned with opening 58 in retaining strip 54. Leg 64 also includes a third opening 70 and a fourth opening 72, the purpose of which is described hereinafter. Retaining strip 54 and holding bracket 60 are interconnected with one another by a first threaded fastener 74 having a threaded shank 75 and a head portion 76 and a second threaded fastener 78 having a threaded shank 79 and a head portion 80. Shank 75 of first fastener 74 passes through opening 66 and threadedly engages opening 56, and shank 79 of second fastener 78 passes through opening 68 and threadedly engages opening 58. Head portions 76 and 80 are larger than openings 66 and 68 and, therefore, as the fasteners are rotated with respect to threaded openings 56 and 58, retaining strip 54 is pulled toward holding bracket 60 thereby clamping flange 18 and flange 24 therebetween. Retaining strip 54 and holding bracket 60 can be clamped to bumper 12 at any point between end 28 and end 30. No holes need to be drilled in the bumper to attach the strip and bracket and therefore the latter can be repositioned as needed to facilitate the attachment of the wall protector to a wall.

Bracket assembly 14 further comprises an L-shaped mounting bracket or wall bracket 82 having a short leg 84 and a long leg 86. Leg 86 includes a first opening 88, a second opening 90, a third opening 92 and a fourth opening 94. A third threaded fastener 96, having a threaded shank 97 and a head portion 98 passes through first opening 88 and threadedly engages a wall anchor 100 in a wall W and a fourth threaded fastener 102 having a threaded shank 103 and a head portion 104 passes through second opening 90 and threadedly engages a second wall anchor 106 in wall W. In this manner, long leg 86 of wall bracket 82 is tightly secured, flush against wall W.

The heads of the fasteners extend outwardly from the bracket to which the fasteners are secured. In order to reduce the profile of the wall protector, the holding bracket includes openings to accommodate the heads of the fasteners for the mounting bracket, and the mounting bracket includes openings to accommodate the heads of the holding bracket fasteners. Specifically, head 98 of fastener 96 is aligned with and fits within opening 70 in holding bracket 60, head 104 of fastener 102 is aligned with an fits within opening 72 in holding bracket 60, head 76 of fastener 74 is aligned with and fits within opening 92 in mounting bracket 82 and head 80 of fastener 78 is aligned with and fits within opening 94 in mounting bracket 82. This arrangement allows wall protector 10 to be mounted closer to wall W than would otherwise be possible, and also prevents the brackets from rotating or sliding relative to one another.

Short leg 62 of holding bracket 60 includes a threaded opening 63 and short leg 84 of mounting bracket 82 includes an opening 83 aligned with opening 63. Holding bracket 60 is smaller than mounting bracket 82 and rests atop mounting bracket 82 such that the corresponding terminal ends of the bracket legs are coplanar. A headed fastener 108 has a threaded shank 109 which passes through opening 83 in leg 84 and into threaded opening 63 in leg 62 to hold the brackets together and thereby connect bumper 12 to wall W. This arrangement allows bumper 12 to be attached and removed by accessing a fastener located beneath the bumper, instead of accessing a fastener in the narrow space between the bumper and the wall which would require a bumper spaced further from the wall than the bumper of the subject invention. Additionally, because holding bracket 60 can be attached anywhere along the length of bumper 12, the mounting brackets can be spaced to take advantage of underlying studs or to otherwise make the attachment thereof to the wall easier. The holding brackets can then be positioned accordingly.

Bumper 12 is preferably made from 16 gauge type 430 stainless steel while brackets 60 and 82 are made from 10 or 12 gauge type 430 stainless steel. The vertical height of front wall 20 is approximately 5½ inches across while top wall 16 and bottom wall 22 are about 1½ inches deep. Mounting bracket assemblies 14 allow bumper 12 to be mounted with rear flanges 18 and 24 spaced just ¼ inch from wall W so that bumper 12 extends only 2 inches from the wall when mounted. The bumper can be cut to any length, but is usually between 5 inches and 10 feet long to facilitate installation.

To install wall protector 10, a plurality of mounting brackets 82 are attached along a wall W at a level where damage is likely to occur. Light 40 is adhesively attached in channel 32 and power cords 48 are attached to power line 52 running through space 38. Protectors can also be mounted one above another if damage is likely at more than one level above the floor. Once the mounting brackets are positioned, holding brackets 60 and retaining strips 54 are joined together and to bumper 12 with flanges 18 and 24 therebetween so as to be in alignment with the mounting brackets. When the brackets are properly aligned and the fastener heads are seated in the appropriate openings in the respective brackets, threaded fasteners 108 are inserted in the openings in the short legs to hold the mounting and holding brackets together. Power line 52 is then connected to the emergency lighting system of the building. Preferably, mounting bracket assemblies 14 are installed at 32 inch intervals along the length of bumpers 12 as well as at the abutting ends between adjacent sections of bumpers. More particularly in this respect, as shown in FIG. 1, multiple sections of bumper 12 can be joined together by positioning a holding bracket 60 between the sections to be joined and clamping both sections between holding bracket 60 and retaining strip 54. In connection with a single bumper strip, or at the terminal ends of a multiple strip installation, mounting bracket assemblies can be attached near the terminal ends of the bumper or multiple bumper assembly as shown with respect to end 28 in FIG. 1. Additionally, when long sections of bumper 12 are needed, multiple bumper sections can be installed end to end and aligned without fastening these sections together. This allows for the easy and efficient installation of long bumper sections one portion at a time.

Stainless steel end caps can be attached at the terminal ends when so desired. These end caps are rectangular and glued, riveted or welded to the ends as required. Alternately, the caps may include a tongue portion normal to the plane of the end cap which can be inserted between retaining strip 58 and flange 24 or between bracket 60 and bracket 80 and clamped in place when these portions are fastened together as described above.

The present invention has been described with respect to a preferred embodiment thereof and it is apparent that other embodiments as well as modifications of the preferred embodiment can be made without departing from the principles of the invention. Accordingly, it will be understood that the foregoing description is to be interpreted merely as illustrative of the invention and not as a limitation thereof.

I claim:

1. A wall protector comprising:

a bumper having first and second spaced ends, a front wall having a channel therein between said first end and said second end, and rear a wall providing an opening between said first end and said second end;

light means disposed in said channel; for providing illumination;

first mounting means for clampingly interengaging with said rear wall;

a bracket for mounting on a wall; and attachment means for attaching said first mounting means to said bracket.

2. A wall protector according to clam 1, wherein said bumper is formed from a unitary sheet of material.

3. A wall protector according to claim 1, wherein said bumper includes an interior cavity accessible through said opening.

4. A wall protector according to claim 3, wherein said rear wall includes a first portion located on a first side of said opening, said first portion having an edge defining a first side of said opening, and a second portion located on a second side of said opening, said second portion having an edge defining a second side of said opening.

5. A wall protector according to claim 4, wherein said first and second portions of said rear wall each include an inner surface and an outer surface, and wherein said first mounting means comprises a first and a second rigid strip respectively overlying said inner and outer surfaces, and means for interconnecting said first and second strips.

6. A wall protector according to claim 5, wherein said first and second strips traverse said opening.

7. A wall protector according to claim 6, wherein said means for interconnecting said strips comprises a threaded opening in said first strip, an opening in said second strip and at least one threaded fastener passing through said opening in said second strip and threadedly engaging said threaded opening in said first strip.

8. A wall protector according to claim 5, wherein said light means comprises a plurality of light bulbs enclosed in a sealed housing mounted in said channel.

9. A wall protector according to claim 8, wherein said light means further includes electric wire means extending into said cavity for connection to a power line for providing electricity to said light bulbs.

10. A wall protector according to claim 9, including first and second end caps for attachment to said first end and said second end.

11. A wall protector according to claim 10, wherein said first and second end caps each include tongue portions clampedly secured between said first and second strips.

12. An illuminated wall protector comprising:

a rail having a top wall, a front wall connected to said top wall, and a bottom wall connected to said front wall, said top wall having a flange generally parallel to said front wall and said bottom wall having a flange generally parallel to said front wall;

lighting means connected to said rail for providing illumination; and mounting means for mounting said rail on a wall, said mounting means comprising a mounting bracket for mounting on said wall; a retainer strip; retainer mounting means for adjustably mounting said retainer strip on said flanges of said top and bottom walls; and securement means for securing said retainer mounting means to said bracket.

13. The wall protector of claim 12, wherein said top and bottom flanges have inner and outer surfaces and said retainer strip engages against said inner surfaces of said flanges.

14. An illuminated wall protector comprising:

a rail having a top wall, a front wall connected to said top wall, and a bottom wall connected to said front wall, said top wall having a flange generally parallel to said front wall and said bottom wall having a flange generally parallel to said front wall, said flanges having inner and outer surfaces;

lighting means connected to said rail for providing illumination; and mounting for mounting means said rail on a wall, said mounting comprising a mounting bracket for mounting on said wall; a retainer strip engaging against said inner surfaces of said flanges; retainer mounting means for adjustably mounting said retainer strip on said flanges of said top and bottom walls; and securement means for securing said retainer mounting means to said bracket, wherein said retainer mounting means comprises a holding bracket engaging against said outer surfaces, said holding bracket having an opening therethrough, said retainer strip including a threaded opening aligned with said holding bracket opening, and a threaded holding bracket fastener extending through said opening in said holding bracket and through said threaded opening in said retainer strip, whereby rotating said holding bracket fastener with respect to said retaining strip draws said retaining strip and said holding bracket toward one another to clamp said top and bottom flanges therebetween.

15. The wall protector of claim 14, wherein said mounting means includes a mounting bracket fastener having a head and said holding bracket fastener includes a head, and wherein said mounting bracket includes an opening for receiving said head of said holding bracket fastener and said holding bracket includes an opening for receiving said head of said mounting bracket fastener.

16. The wall protector of claim 15, wherein said holding bracket is L-shaped and includes a short leg and a long leg and said mounting bracket is L-shaped and includes a short leg and a long leg respectively juxtaposed with said short and long legs of said holding bracket.

17. The wall protector of claim 16, wherein said short leg of said holding bracket includes a threaded opening therein, said short leg of said mounting bracket includes an opening therein aligned with said threaded opening in said holding bracket short leg and wherein said securement means comprises a threaded fastener for passing through said opening in said mounting bracket short leg and threadedly into said opening in said holding bracket short leg.

18. The wall protector of claim 17, wherein said top wall and said bottom wall are parallel to one another.

19. The wall protector of claim 17, wherein said rail has a generally rectangular cross-section.

20. A wall protector for mounting in close proximity to a wall, said wall protector comprising:

a bumper comprising a sheet of material having first and second co-planar edge portions, said first edge portion having an end and said second edge portion having an end, said first end and said second end facing one another and being separated by a gap;

spanning means attached to said edge portions for spanning said gap;

a wall bracket mounted on a wall; and connecting means for connecting said spanning means to said wall bracket.

21. A wall protector according to claim 20, wherein said spanning means comprises a first bracket and first fastener means for attaching said first bracket to said bumper.

22. A wall protector according to claim 21, including second fastener means for mounting said wall bracket on said wall, said first bracket including an opening for receiving a portion of said second fastener means and said wall bracket including an opening for receiving a portion of said first fastener means.

23. A wall protector according to claim 22, wherein first fastener means and said second fastener means are inaccessible when said first bracket is connected to said second bracket.

24. An illuminated wall protector comprising:

a generally rectangular bumper having a top wall, a front wall and a bottom wall, said top wall including a flange generally parallel to said front wall and said bottom wall including a flange co-planar with said top wall flange and spaced apart therefrom, said front wall further including a channel running generally parallel to said top wall and said bottom wall, said bumper defining an interior space;

lighting disposed in said channel for providing illumination; and mounting means for mounting said bumper on a wall comprising a retaining strip in said interior space; a first L-shaped bracket overlaying a portion of said top wall flange, said bottom wall flange and a portion of said bottom wall, said first L-shaped bracket releasably fastened to said retaining strip by at least one threaded fastener; and a second L-shaped bracket for mounting on the wall by at least one threaded fastener, said second L-shaped bracket generally overlaying said first L-shaped bracket and fastened thereto by at least one threaded fastener.

25. A wall protector according to claim 24, wherein said lighting means comprises a strip of lights sealed in a plastic housing.

26. A wall protector according to claim 25, wherein said channel is V-shaped and wherein said housing includes a V-shaped portion for attachment to said V-shaped channel.

27. A wall protector according to claim 26, wherein said housing is adhesively bonded to said V-shaped channel.

28. A wall protector according to claim 27, wherein said lighting means further includes wire means for supplying electricity to said strip of lights and said V-shaped channel includes an opening for connecting said V-shaped channel to said interior space.

29. A wall protector according to claim 28, wherein said V-shaped channel has a bottom and said opening is at the bottom of said channel.

30. A wall protector according to claim 24, wherein said mounting means includes first and second threaded fasteners having a head portion and a threaded shank portion for fastening said first L-shaped bracket to said retaining strip, and third and fourth threaded fasteners having a head portion and a threaded shank portion for fastening said second L-shaped bracket to said wall.

31. A wall protector according to claim 30, wherein:

said first L-shaped bracket includes first and second openings for receiving said shank portion of said first and second threaded fasteners and third and fourth openings for receiving said head portion of said third and fourth threaded fasteners; and said second L-shaped bracket includes first and second openings for receiving said shank portion of said third and fourth threaded fasteners and third and fourth openings for receiving said head portion of said first and second threaded fasteners.

32. A wall protector comprising:

a bumper having first and second spaced ends, a front wall, and a rear wall providing an opening between said first end and said second end;

first mounting means for clampingly interengaging with said rear wall;

a bracket for mounting on a wall; and attachment means for attaching said first mounting means to said bracket.

33. A wall protector comprising:

a generally rectangular bumper having a top wall, a front wall and a bottom wall, said top wall including a flange generally parallel to said front wall and said bottom wall including a flange co-planar with said top wall flange and spaced apart therefrom, said front wall further including a channel running generally parallel to said top wall and said bottom wall, said bumper defining an interior space;

mounting means for mounting said bumper on a wall comprising a retaining strip in said interior space; a first L-shaped bracket overlaying a portion of said top wall flange, said bottom wall flange and a portion of said bottom wall, said first L-shaped bracket releasably fastened to said retaining strip by at least one threaded fastener; and a second L-shaped bracket for mounting on the structure by at least one threaded fastener, said second L-shaped bracket generally overlaying said first L-shaped bracket and fastened thereto by at least one threaded fastener.

* * * * *